US006004003A

United States Patent [19]

Dalton et al.

[11] Patent Number: 6,004,003

[45] Date of Patent: Dec. 21, 1999

[54] PORTABLE LIGHTING DEVICE

[75] Inventors: David R. Dalton, Westlake, Ohio; Peter F. Lynch, Skaneateles, N.Y.

[73] Assignee: Eveready Battery Company, Inc., St. Louis, Mo.

[21] Appl. No.: 08/941,340

[22] Filed: Sep. 30, 1997

[51] Int. Cl.[6] ..... F21L 15/02

[52] U.S. Cl. ..... 362/186; 362/205; 362/307; 362/327; 362/355

[58] Field of Search ..... 362/102, 158, 362/202, 205, 208, 186, 187, 307, 308, 309, 327, 577, 355

[56] References Cited

U.S. PATENT DOCUMENTS

| | | | |
|---|---|---|---|
| 1,676,464 | 7/1928 | Ryan | 362/309 |
| 2,456,166 | 12/1948 | Arenberg | 362/308 |
| 2,726,321 | 12/1955 | Riotto | 362/191 |
| 3,226,538 | 12/1965 | Bustamante | 362/184 |
| 4,234,913 | 11/1980 | Ramme | 362/186 |
| 4,307,439 | 12/1981 | Sassmannshausen | 362/186 |
| 4,531,178 | 7/1985 | Uke | 362/186 |
| 4,559,589 | 12/1985 | Sassmannshausen | 362/309 |
| 4,821,156 | 4/1989 | Siefert et al. | 362/205 |
| 4,839,781 | 6/1989 | Barnes et al. | 362/309 |
| 5,001,612 | 3/1991 | Odlum | 362/187 |
| 5,193,896 | 3/1993 | Oberlander | 362/103 |

FOREIGN PATENT DOCUMENTS

| | | |
|---|---|---|
| 2037416 | 7/1980 | United Kingdom . |
| 2242732 | 5/1993 | United Kingdom . |

*Primary Examiner*—Alan Cariaso
*Attorney, Agent, or Firm*—Robert W. Welsh

[57] ABSTRACT

A portable lighting device according to the present invention includes a battery housing, a light source supported at a first end of the battery housing, and a shroud extending outward from the first end of the battery housing circumferentially around the light source. The shroud is preferably formed of a translucent material having a partially-reflective inner surface for reflecting a portion of incident light emitted from the light source in a forward direction while allowing a portion of the incident light to be transmitted through the shroud and dispersed in peripheral directions. The shroud further preferably includes a diffusing outer surface for diffusing the incident light that is transmitted through the shroud. A shroud is preferably integrally formed with a collar portion as used for threading the integrated head structure onto the battery housing. Additionally, a protective lens cover that may include a collimating lens is also integrally formed in this head structure. Thus, the portable lighting device of the present invention may be constructed with much fewer components and at a much lower cost than conventional flashlights.

41 Claims, 4 Drawing Sheets

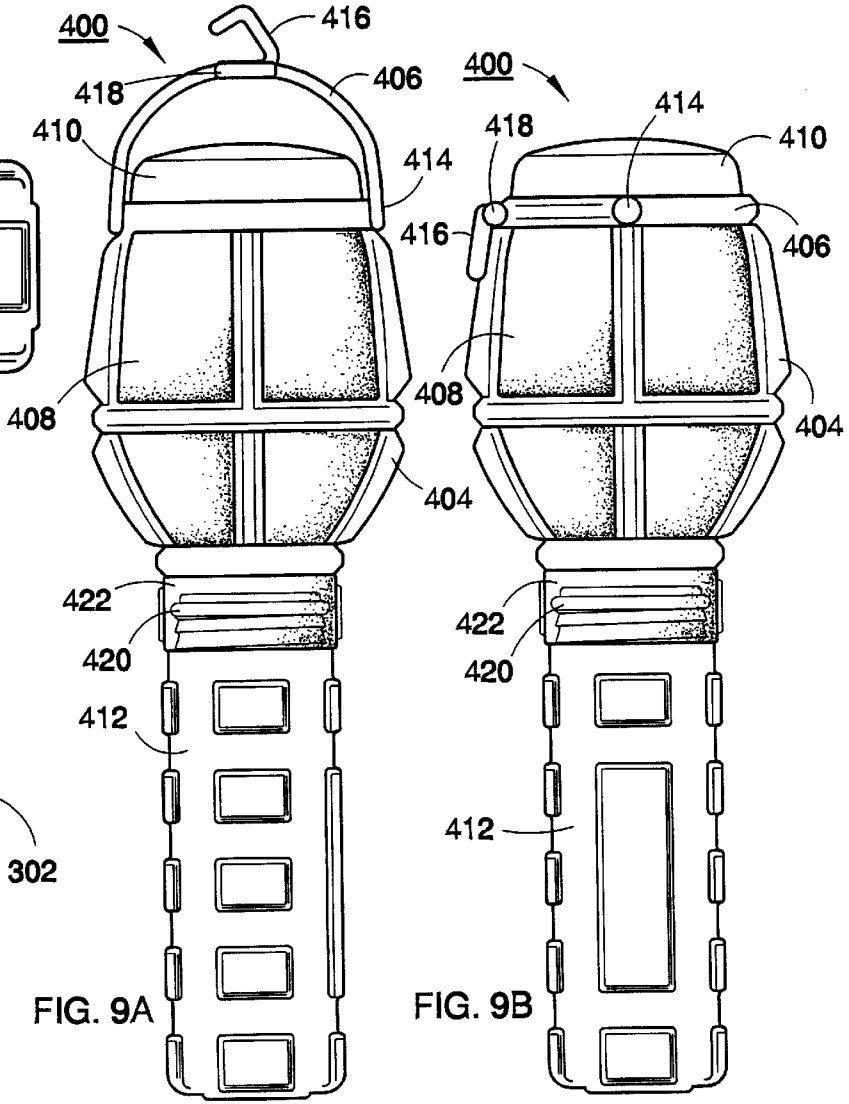
FIG. 9B
FIG. 9A
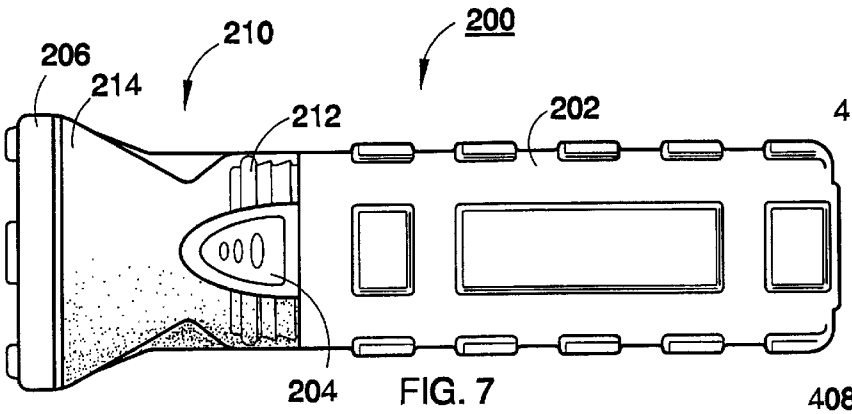
FIG. 7
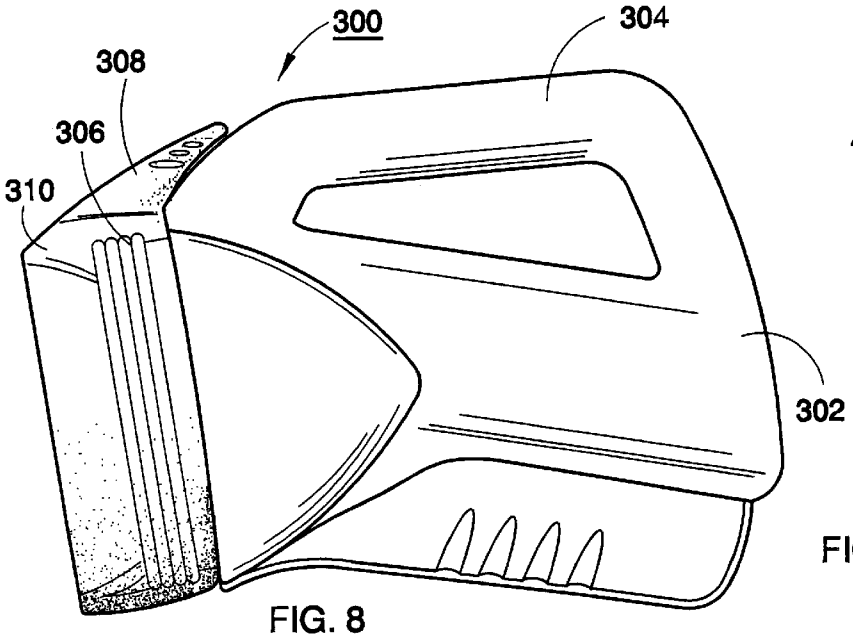
FIG. 8

PORTABLE LIGHTING DEVICE

BACKGROUND OF THE INVENTION

The present invention generally relates to a lighting device. More particularly, the present invention relates to a portable battery-powered lighting device.

Portable lighting devices, such as flashlights and lanterns, are known which produce a directional beam of light. FIG. 1 shows the construction of a relatively low-cost flashlight 10 currently marketed by the assignee of the present invention. Conventional flashlight 10 includes a battery housing 12 of a molded plastic construction, which further serves as a handle for holding the flashlight. As shown in FIG. 1, battery housing 12 has a generally cylindrical shape with one end having an integrally-molded end wall 13. The open end of battery housing 12, in which batteries may be inserted or removed, includes external threads 14 for engaging the internal threads 16 of a shroud 18. Battery housing 12 further includes a slot 20 formed in a side thereof in order to enable a raised portion 22 of a sliding electrical contact 24 to be secured to a switch 26 provided on the exterior of battery housing 12.

Flashlight 10 further includes a spring 28 that is inserted within the battery compartment defined by battery housing 12. Spring 28 is provided in contact with the end wall 13 to bias the inserted batteries forward into contact with a positive terminal 30 of a light bulb 32. Spring 28 further provides an electrical contact to the negative terminal of the rearmost battery inserted into battery housing 12. A fixed electrical contact 34 is also provided within the battery compartment of battery housing 12 to provide an electrical connection between spring 28 and a moving electrical contact 24.

Flashlight 10 further includes a bulb holder 36 having internal threads 38 for engaging external threads provided as a negative electrical contact 40 of light bulb 32. Bulb holder 36 also includes either external threads 42 or a welding surface for securing bulb holder 36 within an aperture 44 provided in an electrical contact shell 46. With such an arrangement, the negative contact terminal 40 of light bulb 32 is electrically coupled through holder 36 to contact shell 46. At the same time, with light bulb 32 screwed into bulb holder 36, positive terminal 30 extends beyond the rearward opening of holder 36 so as to come into contact with a positive terminal of the forwardmost inserted battery. To turn light bulb 32 on and off, switch 26 is slid axially along battery housing 12 thereby moving sliding contact 24 forward and rearward into and out of contact with contact shell 46.

Flashlight 10 additionally includes a reflector 48 having a central aperture for receiving light bulb 32 such that light emitted from light bulb 32 is reflected in a generally forward direction. A lens 50 is provided across the forward opening of the flashlight as defined by shroud 18 and reflector 48 to protect the light bulb from damage. The lens 50, reflector 48, contact shell 46, light bulb 32, and bulb holder 36, which together form a head structure of flashlight 10, are secured across the open end of battery housing 12 by shroud 18, which includes a lip at its forward end to prevent lens 50 and the components positioned to its rear from falling out of the forward end of shroud 18.

Although flashlight 10 represents a relatively low-cost flashlight, it nevertheless includes no less than eleven components. Further, due to the number of potential component interfaces through which water could penetrate to reach the interior of battery housing 12, flashlight 10 would not be considered a waterproof flashlight.

Although conventional lanterns and flashlights such as that described above, are well-suited for brightly illuminating a relatively small area, they are not well-suited for providing wide area illumination like that produced by a lighting device designed for area illumination, such as a table lamp or gas lamp. Such area lamps, however, are not well-suited for directing a beam of light to illuminate an area a considerable distance away. Because of the need in the market for lighting devices that may serve as both a directional light and an area light, various devices have been constructed that will perform both of these functions. In some of these lighting devices, separate light sources and lenses are provided that may be independently activated. An example of one such light is disclosed in commonly-assigned U.S. patent application Ser. No. 08/690,287. Because two separate switches or a multi-position switch is required to selectively power the separate light sources, and because separate light chambers and lenses must be integrated within the device, these devices tend to be much more complex, bulky, and expensive.

To provide a less complex and less expensive portable lighting device that may function as both a directional light source and an area light, the assignee of the present invention has previously developed a two-in-one portable lighting device that utilizes a single light source, and hence, a single on/off switch. An example of such a lighting device is disclosed in British Patent No. 2,242,732B. These lighting devices include a two-part housing in which a first part of the housing contains the batteries, the switch, and the light to source, and a second part of the housing includes two separate chambers. The first and forwardmost chamber is a directional lighting chamber and the second chamber is defined by a cylindrically-shaped diffusing lens integrated within the cylindrical body of the second part of the housing. The second part of the housing may thus be slid axially along the first housing to reposition the light source within one of the two light chambers. Thus, a user may use such a lighting device as a directional light by sliding the second part of the housing fully within the first part of the housing such that the light source is pushed through a small opening within a reflector of the directional light chamber. Then, to use the device as an area light, the user may fully extend the first part of the housing such that the light source is removed from the directional light chamber into the area light chamber where the light emitted therefrom is transmitted through the cylindrical diffusing lens. Although these portable lighting devices are less expensive and bulky than the portable lighting devices that utilize two separate light sources, they nevertheless remain relatively complex and expensive compared to a conventional flashlight. Furthermore, because the single light source may only be in one chamber at any one time, the portable lighting device may not be simultaneously used as a directional light source and an area lamp. Therefore, there exists a need for a portable lighting device that may operate simultaneously as an area light and a directional light while being easily manufactured at a significantly lower cost.

SUMMARY OF THE INVENTION

An aspect of the present invention is to provide a portable lighting device that may function as both a directional light source and an area light. Still another aspect of the present invention is to provide a portable lighting device that simultaneously functions as both a directional light source and an area light using only a single light source.

To achieve these and other aspects and advantages, the portable lighting device of the present invention comprises a battery housing, a light source supported at a first end of the battery housing, and a shroud extending outward from the first end of the battery housing circumferentially around the light source, the shroud being formed of a translucent material and having a partially-reflective inner surface for reflecting a portion of incident light emitted from the light source in a forward direction while allowing the portion of the incident light to be transmitted through the shroud and dispersed in peripheral directions.

It is an additional aspect of the present invention to provide a portable lighting device that is low in cost and easy to assemble. It is a further aspect of the present invention to provide a portable lighting device that includes significantly less components than other portable lighting devices. Still another aspect of the present invention is to provide a portable lighting device that has less components and is waterproof.

To achieve these and other aspects and advantages, the portable lighting device of the present invention consists essentially of a battery housing having an open end and a closed end for housing at least one battery; a first electrical contact extending from the closed end of the battery housing to the open end for providing an electrical connection to a first contact of at least one battery; a light source having first and second contact terminals for receiving power from at least one battery contained in the battery housing, the light source being supported at the open end of the battery housing such that the second contact is electrically coupled to a second contact of at least one battery; an integrally-formed head structure rotatably mounted to the battery housing and extending outward from the open end of the battery housing circumferentially around the light source, the head structure including an integral protective cover for the light source, and having a reflective inner surface for reflecting light emitted from the light source; a seal intermediate the head structure and the battery housing for preventing water from entering the flashlight through an interface between the battery housing and the head structure; and a second electrical contact disposed in the head structure for selectively electrically contacting the first electrical contact when the head structure is rotated to a first position relative to the battery housing and for contacting the first contact of the light source.

These and other features, advantages, and objects of the present invention will be further understood and appreciated by those skilled in the art by reference to the following specification, claims, and appended drawings.

BRIEF DESCRIPTION OF THE DRAWINGS

In the drawings:

FIG. 7 is a perspective view of a flashlight constructed in accordance with a second embodiment of the present invention;

FIG. 8 is a perspective view of a lantern constructed in accordance with the present invention; and FIGS. 9A and 9B are front and side perspective views of a work light constructed in accordance with the present invention.

DETAILED DESCRIPTION OF PREFERRED EMBODIMENTS

As used and described herein, the term "forward" shall refer to the direction in which light is primarily directed when the portable lighting device of the present invention is used as a directional light source. It shall be appreciated that this term as well as others describing the relative orientation of the respective components of the present invention are used solely for the purposes of defining a relationship amongst the components and are not used to limit the invention based on its orientation within any particular environment.

Figure 2:
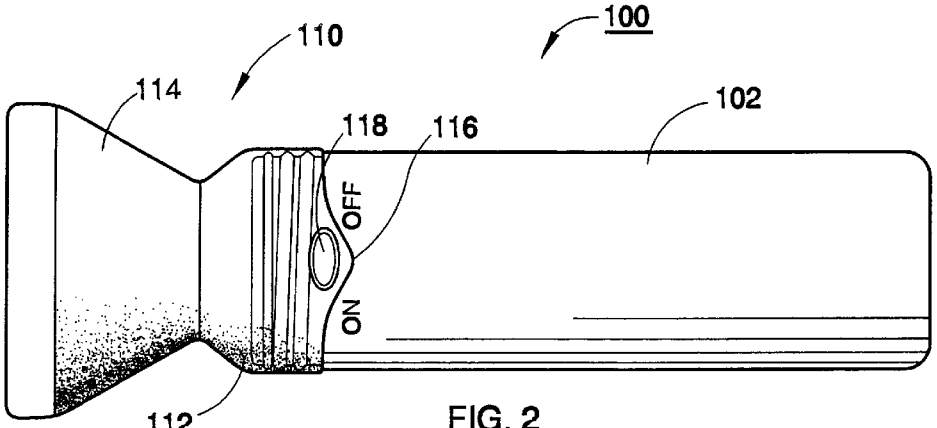
FIG. 2 is a perspective view of a flashlight constructed in accordance with a first embodiment of the present invention.

FIG. 2 shows a flashlight 100 constructed in accordance with a first embodiment of the present invention. Flashlight 100 includes a battery housing 102, which is preferably formed as a hollow cylinder for containing one or more batteries used to provide power to its light source. Battery housing 102 is preferably formed of molded plastic due to its noncorrosive and water-impervious properties as well as its low cost. Flashlight 100 further includes a head structure 110 that includes a collar portion 112 and a light directing portion 114. As described in more detail below, the open end of battery housing 102 as well as a rearward opening cavity defined by collar portion 112, preferably include threads such that head structure 110 may be rotated and attached relative to battery housing 102. As also described in more detail below, electrical contacts are provided within battery housing 102 and head structure 110 such that rotation of head structure 110 between specified positions will turn the light source on and off. As shown in FIG. 2, this particular configuration includes a tab 116 that extends rearward of collar portion 112. Table 116 has a recess or aperture 118 for enabling a user to more easily rotate head structure 110 relative to battery housing 102. Tab 116 is also provided to enable a user to quickly determine whether head structure 110 has been rotated to the on or off position.

Figure 3:
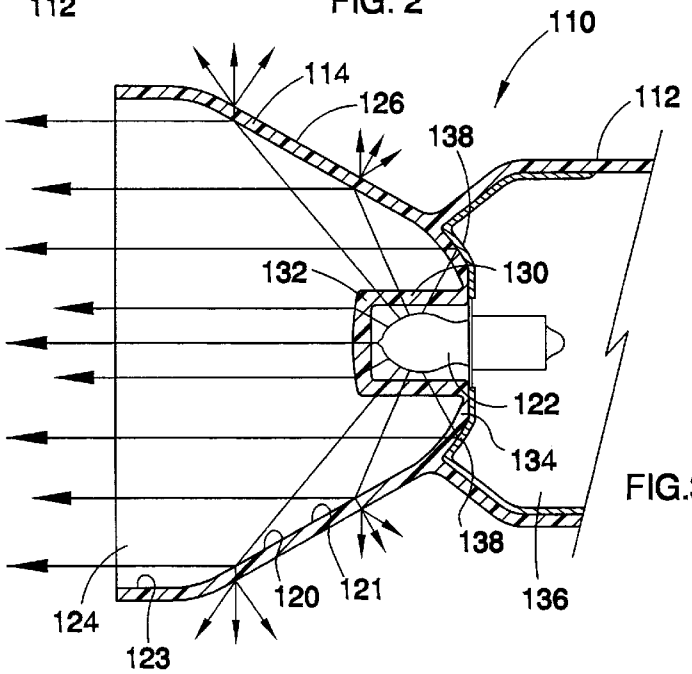
FIG. 3 is a light ray diagram illustrating the operation of a flashlight constructed in accordance with one aspect of the present invention.

As illustrated in FIG. 3, head structure 110 is preferably formed of a translucent material that allows some of the light emitted from a light source 122 to be transmitted through the walls of head structure 110. Head structure 110 may be formed of polypropylene or other suitable materials. The light directing portion of head structure 110, which functions as a shroud, includes a forward-facing open cavity 124 that is defined and bounded by an inner surface 120 of shroud 114. Inner surface 120 is preferably partially reflective and partially transmissive such that a portion of the light incident thereon that is emitted from light source 122 and is reflected in a collimated fashion as a directional beam of light, while a remaining portion of the incident light is transmitted through the walls of shroud 114. Inner surface 120 preferably includes a parabolic portion 121 located in the rearward portion of cavity 124 with light source 122 located at the focal point of the parabola. Inner surface 120 may also include a forward portion 123 having a constant diameter.

Figure 4B:
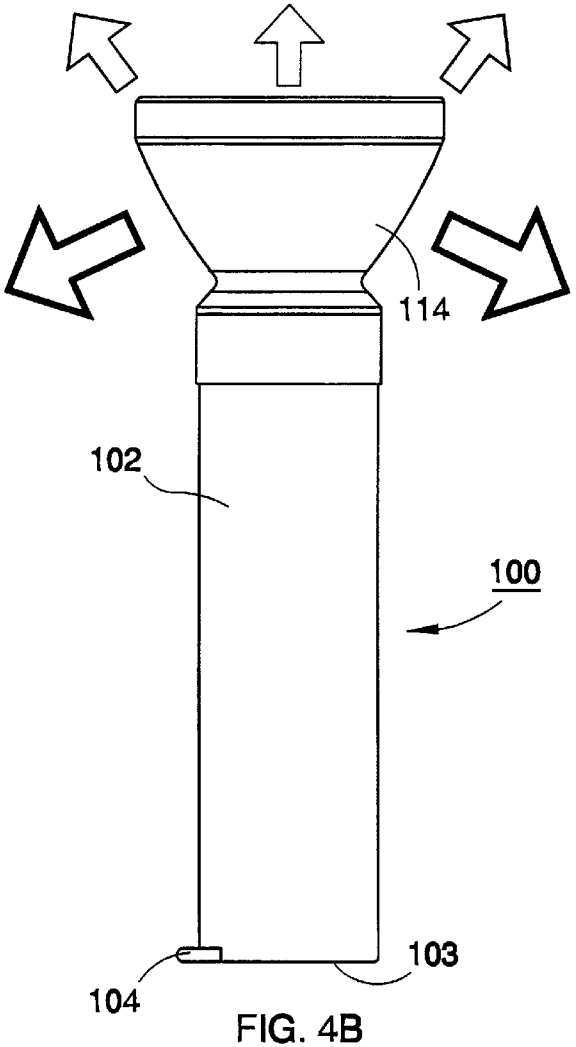
FIGS. 4A–4C are side elevational views illustrating various configurations for a flashlight constructed in accordance with the present invention.
Figure 4A:
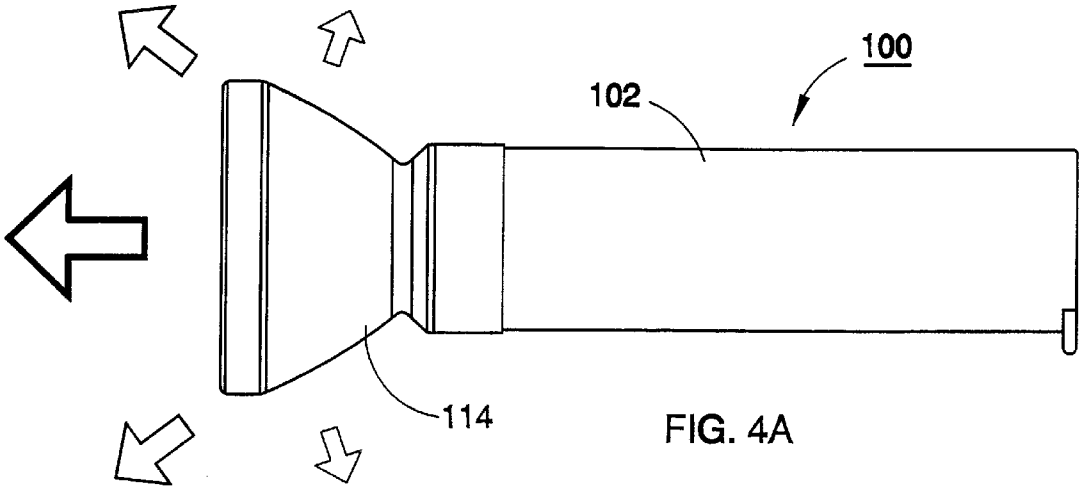
Figure 4C:
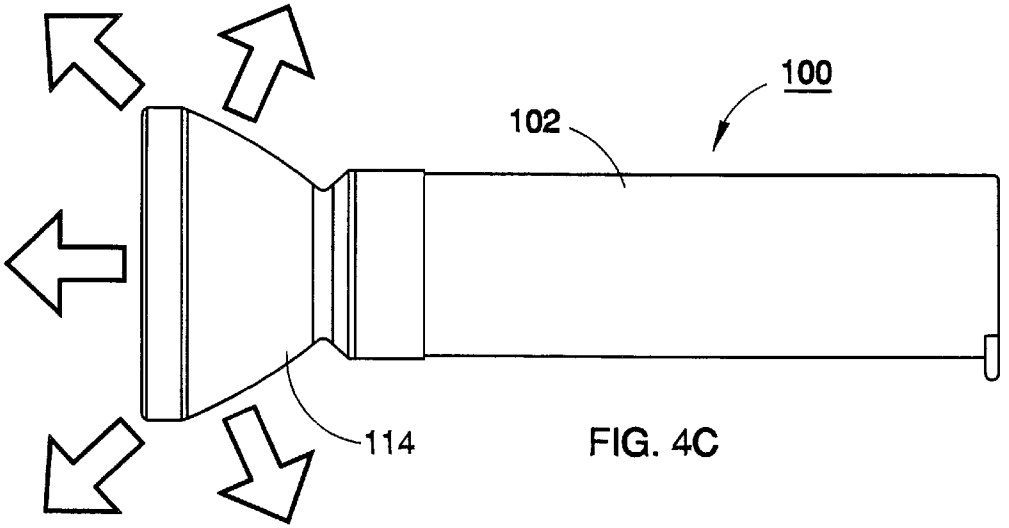

Preferably, the exterior surface 126 of shroud 114 is textured to diffuse the light that is transmitted through the shroud walls. The reflectivity of inner surface 120 may be selectively varied by the degree of smoothness thereof. Further, the amount of diffusing of the light transmitted through the walls of shroud 114 may be varied in different portions of shroud 114 and may be varied more generally and uniformly to affect the amount of diffusion of the transmitted incident light. Thus, with reference to FIG. 4A, a very smooth inner surface 120 would result in a greater percentage of light being transmitted in a directional collimated beam of light while a lesser degree of smoothness would result in a higher percentage of light being transmitted peripherally through the walls of shroud 114 as illustrated in FIG. 4B. Moreover, as shown in FIG. 4C, the reflectivity of the inner surface of shroud 114 may be controlled such that equal percentages of light are reflected directionally forward or transmitted through the walls of shroud 114 in peripheral directions. Thus, as apparent from the examples illustrated in FIGS. 4A–4C, the flashlight may be manufactured differently depending upon the primary use, such as an area light or directional light, for which the lighting device will be employed. To effectively function as both a directional light and an area light, at least ten percent (10%) of the light should be reflected directionally forward or diffused peripherally. The relative smoothness of inner surface 120 may be varied during manufacture by controlling the degree of smoothness of the corresponding surface of the mold, or by polishing inner surface 120 after head 110 is removed from the mold.

As shown in FIG. 4B, a leg 104, which extends axially outward at the closed end of battery housing 102, may be included to provide additional support such that flashlight 100 may be stood on end 103 for use as an area lamp.

By providing a shroud that is translucent in the manner described above, a lighting device functions simultaneously as a directional light and an area light while using only a single light source. With this construction, a lighting device according to the present invention may be constructed at a much lower cost than conventional lighting devices that also provide for simultaneous use as a directional light and area light.

A principal benefit of using a lighting device simultaneously as a directional light and an area light is that not only will the user be able to illuminate an area in a directional sense, but it will allow others to be able to see the user as well. Thus, the lighting device also functions as a locator light. Further, by directing light peripherally outwardly in addition to providing a collimated directional beam, users walking down a dark path may direct the directional beam a distance in front of them while still having illumination at their feet. Such peripheral illumination may be provided regardless of the rotational position of the flashlight about its central axis.

Referring back to FIG. 3, it is noted that head structure 110 may additionally include an integrally-formed protective cover 130 that is also generally transparent and shaped in the form of a dome. Cover 130 is provided to protect bulb 122. By integrally forming protective cover 130 with the other portions of head structure 110, water cannot enter the flashlight assembly through the open end of cavity 124. The forwardmost end of protective cover 130 is preferably formed as a collimating lens 132 so as to collimate the light transmitted therethrough from light source 122. As illustrated, light that does not transmit through collimating lens 132 exits cover 130 at a sufficient angle to be incident upon a portion of the inner surface 120 of shroud 114. Due to the partially-reflective nature of inner surface 120 and due to the generally parabolic shape in which inner surface 120 is preferably formed, the reflected light is directed in a forward direction in a generally collimated beam.

Because head structure 110 is an integrally-formed structure made of a single material, such as a plastic, and because the material is preferably translucent, light incident upon a rear wall 134 of shroud 114 would be partially transmitted through wall 134 and into a rearward facing cavity 136 defined by collar 112. Because light transmitted into this rearward facing cavity 136 would provide no useful illumination since it would be unlikely to reach the exterior of the battery compartment, a reflector 138 is provided opposite inner surface 120 of wall 134. Preferably, reflector 138 is a highly-reflective aluminum or chromium coating that may be applied to rear wall 134 after head structure 110 has been molded. With reflector 138 in place, no light emitted from light source 122 is transmitted into the battery compartment. Thus, all the light from light source 122 is either reflected directionally forward or diffused peripherally outward through the walls of shroud 114.

Figures 1, 5:
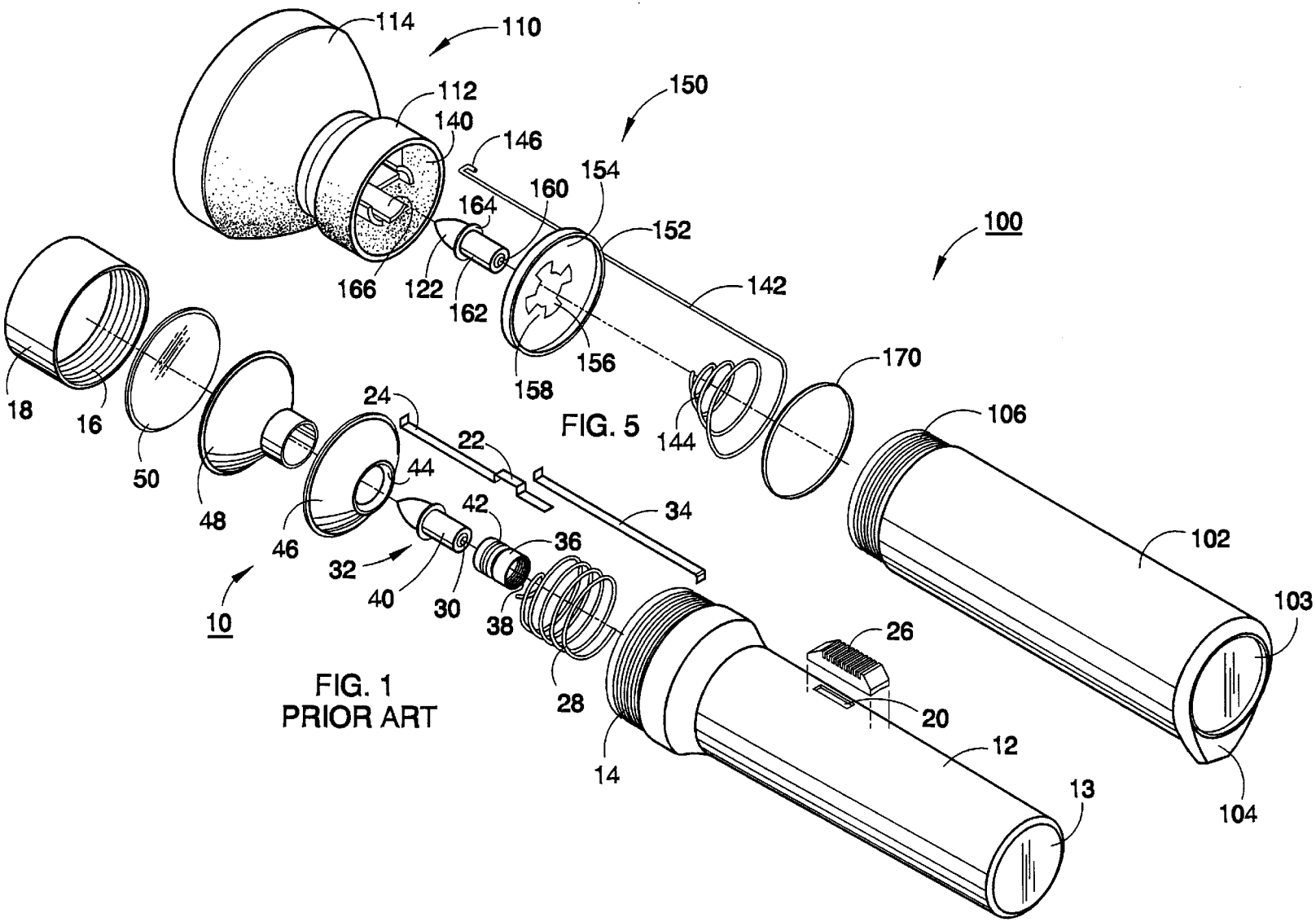
FIG. 1 PRIOR ART
FIG. 1 is an exploded perspective view of a conventional flashlight.
FIG. 5 is an exploded perspective view of a flashlight constructed in accordance with a first embodiment of the present invention.

A more detailed view of the overall preferred construction of flashlight 100 is shown in FIG. 5. As shown in FIG. 5, the forward open end of battery housing 102 includes threads 106 on an outer surface thereof for engaging threads 140 provided on an inner surface of collar portion 112 of head structure 110. An electrical connection from the rear wall 103 to the open end of battery housing 102 is provided by an electrical connector 142 which consists of a wire that is formed into a spring 144 at an end that contacts the inner surface of end wall 103. The other end of electrical contact 142 is terminated with a hook 146 that wraps around the edge of battery housing 102 at its open end. Hook 146 of electrical connector 142 is positioned to contact the contact ring 152 of a combined bulb holding/contact shell 150.

Contact shell 150 is an integrally-formed metallic structure having a disk-like portion 154 provided in contact with a forward edge of ring 152. Preferably, the forward surface of the disk-like member 154 is highly polished or plated to serve as a reflector, such as reflector 138 shown in FIG. 3. To the extent that the rear wall 134 of shroud 114 is contoured, disk-like member 154 may be similarly contoured to closely fit against wall 134. Disk portion 154 of contact shell 150 includes a central hole 158 having a diameter larger than that of a negative contact 162 of bulb 122 and yet smaller than a radially-extending ridge 164 extending at the forward end of the negative contact 162. With this structure, bulb 122 is supported such that the light-emitting portion of the bulb extends within the forward opening cavity and the positive and negative contacts 160 and 162, respectively, protrude rearwardly into the rearward facing cavity defined by collar portion 112 and into the battery compartment. Additionally, a plurality of notches 156 extend outwardly from central hole 158 for receiving a corresponding prong 166 extending rearwardly from rear wall 134 within the rearwardly opening cavity defined within collar 112. By providing such a structure, contact shell 150 fits snugly within the rearwardly opening cavity of collar 112 so as to hold bulb 122 in place.

Further, in addition to performing this bulb holding function, contact shell 150 serves to provide an electrical connection between negative terminal 162 of bulb 122 and electrical connector 142, which contacts the negative terminal of the rearmost battery provided in battery housing 102. With head structure 110 threaded onto battery housing 102, positive terminal 160 of bulb 122 is in constant contact with a positive terminal of a forwardmost battery provided in housing 102. Additionally, with head structure 110 rotated onto housing 102 as far as it can go, hook 146 of electrical connector 142 is brought into contact with the inner surface of contact ring 152 thereby providing the complete electrical connection between the batteries and light bulb 122. To disrupt the delivery of power to bulb 122 and thereby turn the flashlight off, head structure 110 is rotated thereby moving contact ring 152 outwardly from hook 146 and thereby breaking the electrical connection between the negative terminals of the batteries and the negative contact of bulb 122.

With this structure, the additional parts for providing a switching mechanism may be eliminated, thereby significantly reducing the cost and complexity of the flashlight. Further, by integrating the electrical connector and the spring, additional parts may also be eliminated. The largest number of parts are eliminated, however, by the implementation of integrated head structure 110, which combines all the features and functions of a shroud, lens, reflector, and bulb support in a single molded unit. Furthermore, by providing an optional O-ring, gasket, or other seal 170 at the end of battery housing 102, the flashlight may be readily made waterproof since the only interface through which water could reach the interior of the battery would be through the interface between battery housing 102 and head structure 110. Thus, the eleven components of the conventional flashlight shown in FIG. 1 may be reduced to a total of five components with an optional sixth component added to make the flashlight waterproof. As stated above, it would be very complicated to modify the conventional eleven-component flashlight to be waterproof.

In addition, by comparing the flashlights of FIG. 1 and FIG. 5, one can see that flashlight 100 of the present invention provides an additional feature in that it functions as an area lamp in addition to a directional flashlight. Thus, for a lower cost, a consumer may purchase a flashlight having additional functions not provided by the conventional flashlight.

Figure 6A:
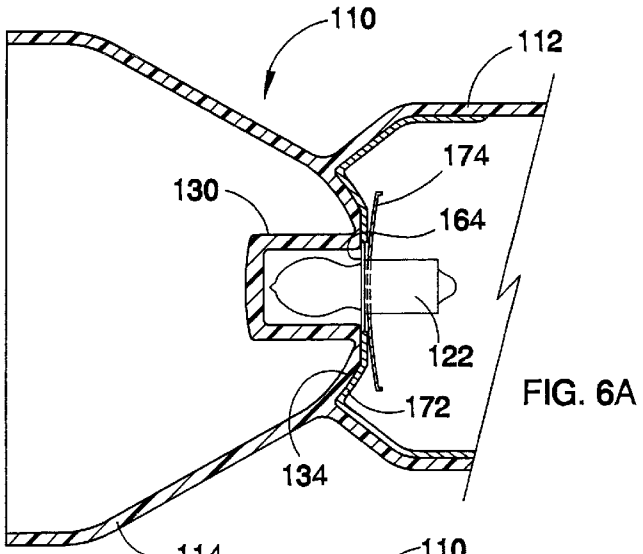
FIGS. 6A and 6B are cross-sectional views of the head structure of a flashlight constructed in accordance with the present invention illustrating two different mechanisms for supporting a light bulb relative to the head structure.
Figure 6B:
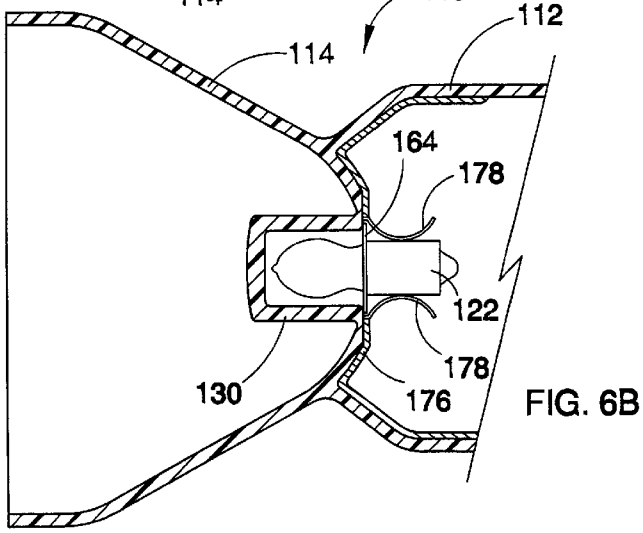

Referring to FIGS. 6A and 6B, two alternative constructions are shown for holding light bulb 122 in place relative to head structure 110. In FIG. 6A, a bulb holder 174 is provided that is similar to the bulb holder/contact shell 150 shown in FIG. 5 except that the contact ring 152 is removed and the outer diameter of shell 150 is reduced. Thus, bulb holder 174 holds the bulb in place in a similar manner as that shown in FIG. 5. To provide electrical contact between the negative terminal portion of bulb 122 and hook 146 of electrical connector 142, an electrically-conductive and highly-reflective coating 172 is formed on the rear surface of rear wall 134 as well as the interior surface area of collar 112.

Referring to FIG. 6B, a combination contact shell/bulb holder 176 is illustrated that is contoured to the interior surface of the rearwardly facing cavity defined by collar 112 so as to serve as a reflector and an electrical contact. The contact shell/bulb holder 176 further includes two or more resilient tabs 178 that are biased inwardly against the bulb. It will be appreciated that resilient tabs 178 could be configured differently and made of plastic material so as to be integrally formed with the other portions of head structure 110.

Although the present invention has been described as utilizing a fully integrated head structure 110 that includes a protective cover 130 integrated with the remaining portion of head structure 110, it will be appreciated by those skilled in the art that protective cover 130 could be formed separately, and ultrasonically welded within the forwardly facing cavity. By forming protective cover 130 separately, the remaining portion of head structure 110 may be formed using a material that is slightly more opaque, or using a colored material, whereas protective cover 130 may be made of a clear transparent material or a material of a different color.

FIG. 7 shows a flashlight 200 constructed in accordance with a second embodiment of the present invention. As shown, flashlight 200 includes a contoured and/or textured battery housing/handle 202, which may be formed of plastic or metal and have a rubber exterior coating. Flashlight 200 further differs from flashlight 100 of the first embodiment in that a push-button toggle switch 204 is provided on head structure 210. By providing a push-button switch 204, head structure 210 need not be rotated relative to battery housing 202 to turn the light on and off.

Head structure 210 of flashlight 200 is preferably constructed in the same manner as head structure 110 of flashlight 100 discussed above, such that it will enable flashlight 200 to simultaneously function as an area light and a directional light. An end guard 206 may optionally be provided about the forward edge of shroud 214. End guard 206 may be formed of an opaque plastic material or may be formed of a hard rubber material to absorb shock if the flashlight were dropped.

FIG. 8 shows a lantern 300 constructed in accordance with the present invention. Lantern 300 preferably includes a battery housing 302 having an integrally-formed handle 304. At one end, battery housing 302 includes threads for engaging the threads provided on a head structure 310. Head structure 310 is preferably configured in a similar manner to the flashlights discussed above in that it is preferably formed of a translucent material having a highly-polished parabolically-shaped interior surface for partially reflecting the light from the light bulb (not shown) and for allowing a portion of the light striking the interior surface to be transmitted through the walls of head structure 310 and diffused outwardly in peripheral directions. Because the light bulb in such lanterns typically is positioned with its bulb portion within the battery housing 302, it is preferable to coat the backside of head assembly 310 that extends within battery housing 302 with a highly-reflective material so that light transmitted through head structure 310 cannot enter into the battery compartment in the interior of housing 302. The light source in lantern 300 may be turned on and off by providing a push-button switch in proximity to handle 304 or by rotating head structure 310 in a manner similar to that described above with respect to the flashlight of the first embodiment of the invention. To facilitate turning of head structure 310 between on and off positions, a tab 308 may be provided that protrudes outwardly from head structure 310.

As shown in FIGS. 9A and 9B, the inventive concept of the present invention may be applied to a work light. Similar to conventional work lights, work light 400 includes a cage structure 404, which serves to protect the light bulb from damage if the work light were dropped. Further, work light 400 includes a hanger 406 for hanging the work light in a location where the light will be projected onto the work area. Work light 400 differs from a conventional work light, however, in that it includes a diffusing lens 408 for diffusing light transmitted therethrough from the light source. Preferably, the inner surface of diffusing lens 408 is highly polished such that a portion of the light incident on the inner surface is reflected outwardly as a directional beam through a lens portion 410. Lens portion 410 is provided on an opposite end of diffusing lens 408 from a battery housing 412. The portion of diffusing lens 408 positioned closest to battery housing 412 is preferably parabolically shaped with a light bulb supported at the focal point of the parabola such that a significant amount of light from the light source is directed through lens 410.

To facilitate the use of work light 400 as a directional light source, hanger assembly 406 is preferably pivotally mounted to cage 404 about a pair of pivot points 414. In this manner, hanger assembly 406 may be folded down as shown in FIG. 9B so as to not obstruct light projected from lens 410. Hanger assembly 406 preferably includes a hook 416 that is pivotally mounted on hanger structure support 406 on a rounded portion thereof or on a pivot pin 418 provided on support 406.

Battery housing 412 preferably includes threads 420 for engaging threads formed in a collar portion 422 integrally formed at the lower-rearward end of diffusing lens 408. Work light 400 may be provided with a push-button switch for turning the light source on and off or may be provided with an electrical connector structure similar to that shown in FIG. 5 such that the light source is turned on and off by rotation of battery housing 412 relative to the head portion of work light 400. Although work light 400 is shown as being powered by batteries, it will be appreciated by those skilled in the art that the concepts of the present invention would be equally applicable to an alternating current (AC)-powered work light or a direct current (DC) worklight that does not include such a battery housing. By providing a combination area light and directional light in a work light, a person using work light 400 may, for example, use the work light with its hanger for area illumination of the work surface and then use the same work light as a directional light to more brightly illuminate a smaller area within the larger work area. Further, by forming lens 410, diffusing lens 408, and collar 422 as an integral structure, and by providing an O-ring, gasket, or seal at the interface of battery compartment 412 and collar 422, one may readily transform work light 400 into a waterproof work light.

Although the present invention has generally been described as a low-cost lighting device, it will be appreciated by those skilled in the art that various concepts described herein may be employed in various other forms of lighting devices that are more complex and more expensive without departing from the spirit and scope of the present invention. For example, the concept of utilizing a partially-reflective and partially-transmissive shroud may be employed in various lighting devices regardless of their expense or complexity. Similarly, it will be appreciated that a low-cost flashlight such as that shown in FIG. 5 may be made with a relatively opaque shroud, such as a white plastic, that reflects substantially all the light emitted from the light source as a directional light beam. Although such a flashlight would not have the advantages of simultaneously operating as an area light, it would nevertheless benefit from having relatively few components and a lower manufacturing cost than conventional low-cost flashlights.

It will further be appreciated that the portable lighting devices described above may be powered by either rechargeable or non-rechargeable batteries. Further, it will also be appreciated that, if rechargeable batteries are used, the portable lighting devices could be modified to include extendible prongs for recharging the batteries without removing them from the battery housing.

The above description is considered that of the preferred embodiments only. Modifications of the invention will occur to those skilled in the art and to those who make or use the invention. Therefore, it is understood that the embodiments shown in the drawings and described above are merely for illustrative purposes and not intended to limit the scope of the invention, which is defined by the following claims as interpreted according to the principles of patent law, including the Doctrine of Equivalents.

The invention claimed is:

1. A portable lighting device comprising:

a battery housing;

a light source supported at a first end of said battery housing; and a shroud extending outwardly from said first end of said battery housing circumferentially around said light source, said shroud being formed of a translucent material and having a partially-reflective inner surface for reflecting a portion of incident light emitted from said light source in a forward direction while allowing a portion of the incident light to be transmitted through said shroud and dispersed in peripheral directions.

2. The portable lighting device as defined in claim 1, wherein said shroud further includes a diffusing outer surface for diffusing the incident light that is transmitted through said shroud.

3. The portable lighting device as defined in claim 1, wherein said shroud further includes an integrally-formed transparent dome for covering said light source.

4. The portable lighting device as defined in claim 3, wherein said dome includes an integrally-formed collimating lens.

5. The portable lighting device as defined in claim 3, wherein said dome protrudes outward from a rearward end of said inner surface of said shroud.

6. The portable lighting device as defined in claim 1, wherein said inner surface of said shroud has a parabolic shape.

7. The portable lighting device as defined in claim 1, wherein said shroud is made of a plastic material.

8. The portable lighting device as defined in claim 1, wherein said partially-reflective inner surface of said shroud reflects at least ten percent of the light incident thereon.

9. The portable lighting device as defined in claim 1, wherein said shroud includes threads on a rearward portion thereof for operatively engaging threads on said first end of said battery housing.

10. The portable lighting device as defined in claim 1, wherein said shroud includes an electrical contact for selectively contacting a conductive strip on said first end of said battery housing when said shroud is rotated relative to said battery housing.

11. The portable lighting device as defined in claim 1 and further including a reflector disposed adjacent a surface of said shroud that defines a wall of a battery compartment that is further defined by said battery housing.

12. The portable lighting device as defined in claim 11, wherein said reflector is a reflective coating applied to said shroud.

13. The portable lighting device as defined in claim 1, wherein said lighting device is a flashlight.

14. The portable lighting device as defined in claim 1, wherein said lighting device is a lantern.

15. The portable lighting device as defined in claim 1, wherein said lighting device is a work light.

16. An integral head structure for a portable lighting device having a battery housing, said head structure comprising:

a mounting portion for mounting the integral head structure to the battery housing;

a light directing portion formed forward of said mounting portion and defining a forwardly opening first cavity, said light directing portion having a smooth reflective surface on the inside of said first cavity for directing light from a light bulb in a forward direction; and a light bulb supporting portion intermediate said mounting portion and said light directing portion for supporting a light bulb such that an electrical contact of the light bulb is exposed to the battery housing for receiving power from a battery contained therein, and such that a light-emitting end of the light bulb extends into said first cavity.

17. The integral head structure as defined in claim 16, wherein said reflecting surface of said light directing portion partially reflects incident light from the light bulb and partially transmits the incident light to an outer surface of said light directing portion for dispersion in peripheral directions other than the forward direction.

18. The integral head structure as defined in claim 17, wherein said outer surface of said light directing portion is textured to diffuse the incident light that is transmitted through said light directing portion.

19. The integral head structure as defined in claim 16, wherein said mounting portion includes a collar defining a rearwardly opening second cavity in which threads are provided for engaging threads on the battery housing to rotatably mount the head structure to the battery housing.

20. The integral head structure as defined in claim 16, wherein said first cavity defined by said light directing portion is parabolic.

21. The integral head structure as defined in claim 16, wherein said mounting, light directing, and light bulb supporting portions are made of a plastic material.

22. The integral head structure as defined in claim 16, wherein said mounting, light directing, and light bulb supporting portions are made by molding.

23. The integral head structure as defined in claim 16, wherein said light directing portion further includes an integrally-formed transparent dome for covering the light bulb.

24. The integral head structure as defined in claim 23, wherein said transparent dome includes an integrally-formed collimating lens.

25. The integral head structure as defined in claim 23, wherein said transparent dome protrudes forwardly from a rearward end of said first cavity.

26. The integral head structure as defined in claim 23, wherein said integrally-formed transparent dome provides a waterproof cover for preventing water entering said first cavity from contacting the light bulb.

27. A portable lighting device comprising:

a light source; and a shroud extending circumferentially around said light source, said shroud being formed of a translucent material and having a partially-reflective inner surface for reflecting a portion of incident light emitted from said light source in the forward direction while allowing a portion of the incident light to be transmitted through said shroud and dispersed in peripheral directions.

28. The portable lighting device as defined in claim 27, wherein said inner surface of said shroud has a parabolic shape.

29. The portable lighting device as defined in claim 27, wherein said shroud further includes a diffusing outer surface for diffusing the incident light that is transmitted through said shroud.

30. A portable lighting device consisting essentially of:

a battery housing having an open end and a closed end for housing at least one battery;

a first electrical contact extending from said closed end of said battery housing for providing an electrical connection to a first contact of the at least one battery;

a light source having first and second contact terminals for receiving power from the at least one battery contained in said battery housing, said light source being supported at said open end of said battery housing such that said second contact terminal is electrically coupled to a second contact of the at least one battery;

an integrally-formed head structure mounted to said battery housing and extending outward from said open end of said battery housing circumferentially around said light source, said head structure including a protective cover for said light source, and having a reflective inner surface for reflecting light emitted from said light source;

a second electrical contact disposed in said head structure for selectively electrically contacting said first electrical contact and for contacting said first contact terminal of said light source; and a switching mechanism for selectively coupling said first electrical contact to said second electrical contact.

31. The portable lighting device as defined in claim 30, wherein said first electrical contact includes an integrally-formed spring for biasing the at least one battery against said second contact terminal of said light source.

32. The portable lighting device as defined in claim 30, wherein said head structure is translucent such that said inner surface of said head structure is partially reflective and partially transmissive.

33. The portable lighting device as defined in claim 32, wherein said head structure further includes a diffusing outer surface for diffusing the incident light that is transmitted through said inner surface.

34. The portable lighting device as defined in claim 30, wherein said protective cover includes a lens for collimating light emitted from said light source.

35. The portable lighting device as defined in claim 30, wherein said head structure and said second electrical contact cooperate to releasably mount said light source to said head structure.

36. The portable lighting device as defined in claim 30, wherein said inner surface of said head structure has a parabolic shape.

37. The portable lighting device as defined in claim 30, wherein said head structure is made of a plastic material.

38. A waterproof flashlight consisting essentially of:

a battery housing having an open end and a closed end for housing at least one battery;

a first electrical contact extending from said closed end of said battery housing to said open end for providing an electrical connection to a first contact of the at least one battery;

a light source having first and second contact terminals for receiving power from the at least one battery contained in said battery housing, said light source being supported at said open end of said battery housing such that said second contact terminal is electrically coupled to a second contact of the at least one battery;

an integrally-formed head structure rotatably mounted to said battery housing and extending outward from said open end of said battery housing circumferentially around said light source, said head structure including an integral protective cover for said light source, and having a reflective inner surface for reflecting light emitted from said light source;

a seal provided intermediate said head structure and said battery housing for preventing water from entering said flashlight through an interface between said battery housing and said head structure; and a second electrical contact disposed in said head structure for selectively electrically contacting said first electrical contact when said head structure is rotated to a first position relative to said battery housing, and for contacting said first contact terminal of said light source.

39. A flashlight consisting essentially of:

a battery housing having an open end and a closed end for housing at least one battery;

a first electrical contact extending from said closed end of said battery housing to said open end for providing an electrical connection to a first contact of the at least one battery;

a light source having first and second contact terminals for receiving power from the at least one battery contained in said battery housing, said light source being supported at said open end of said battery housing such that said second contact terminal is electrically coupled to a second contact of the at least one battery;

an integrally-formed head structure rotatably mounted to said battery housing and extending outward from said open end of said battery housing circumferentially around said light source, said head structure including a protective cover for said light source, and having a partially-reflective inner surface for reflecting a portion of the incident light emitted from said light source in a forward direction and for transmitting a portion of the incident light through said head structure, said head structure further including a light source mounting wall formed in a rearward portion of said head structure, a forward surface of said light source mounting wall constituting a part of said partially-reflective inner surface;

a reflector provided adjacent to said light source mounting wall for reflecting the portion of incident light that is transmitted through said light source mounting wall back through said wall; and a second electrical contact disposed in said head structure for selectively electrically contacting said first electrical contact when said head structure is rotated to a first position relative to said battery housing, and for contacting said first contact terminal of said light source.

40. The flashlight as defined in claim 39, wherein said reflector is a reflective coating applied to said light source mounting wall of said head structure.

41. A flashlight consisting essentially of:

a battery housing having an open end and a closed end for housing at least one battery;

a first electrical contact extending from said closed end of said battery housing to said open end for providing an electrical connection to a first contact of the at least one battery;

a light source having first and second contact terminals for receiving power from the at least one battery contained in said battery housing, said light source being supported at said open end of said battery housing such that said second contact terminal is electrically coupled to a second contact of the at least one battery;

an integrally-formed head structure rotatably mounted to said battery housing and extending outward from said open end of said battery housing circumferentially around said light source, said head structure including a protective cover for said light source, and having a reflective inner surface for reflecting light emitted from said light source; and a second electrical contact disposed in said head structure for selectively electrically contacting said first electrical contact when said head structure is rotated to a first position relative to said battery housing, and for contacting said first contact terminal of said light source.

* * * * *